US010873166B2

(12) United States Patent
Hughes et al.

(10) Patent No.: US 10,873,166 B2
(45) Date of Patent: Dec. 22, 2020

(54) LOW PIM PASSIVE CONNECTION SYSTEM FOR CELLULAR NETWORKS

(71) Applicant: Hughes Electronics Limited, London (GB)

(72) Inventors: Glyn Hughes, London (GB); Grzegorz Rymar, London (GB)

(73) Assignee: HUGHES ELECTRONICS LIMITED, London (GB)

( * ) Notice: Subject to any disclaimer, the term of this patent is extended or adjusted under 35 U.S.C. 154(b) by 438 days.

(21) Appl. No.: 15/325,150

(22) PCT Filed: Aug. 18, 2015

(86) PCT No.: PCT/GB2015/000246

§ 371 (c)(1),
(2) Date: Jan. 19, 2017

(87) PCT Pub. No.: WO2016/027050

PCT Pub. Date: Feb. 25, 2016

(65) Prior Publication Data

US 2017/0162989 A1 Jun. 8, 2017

(51) Int. Cl.
*H01R 24/56* (2011.01)
*H01R 13/622* (2006.01)
(Continued)

(52) U.S. Cl.
CPC ..... *H01R 24/564* (2013.01); *H01R 13/56* (2013.01); *H01R 13/622* (2013.01);
(Continued)

(58) Field of Classification Search
CPC ..... H01R 2103/00; H01R 24/564; H01R 13/622; H01R 13/5202; H01R 13/521;
(Continued)

(56) References Cited

U.S. PATENT DOCUMENTS 3,793,610 A * 2/1974 Brishka ..... H01R 13/6277 439/349
4,046,451 A * 9/1977 Juds ..... H01R 24/564 174/75 C (Continued)

FOREIGN PATENT DOCUMENTS

| | | |
|---|---|---|
| DE | 9400943 U1 | 4/1994 |
| DE | 4309775 A1 | 9/1994 |
| GB | 2530708 A | 4/2016 |

OTHER PUBLICATIONS

International Search Report dated Feb. 4, 2016 for corresponding International Application No. PCT/GB2015/000246, filed Aug. 18, 2015.

(Continued)

*Primary Examiner* — Edwin A. Leon
*Assistant Examiner* — Matthew T Dzierzynski
(74) *Attorney, Agent, or Firm* — David D. Brush; Westman, Champlin & Koehler, P.A.

(57) ABSTRACT

At radio frequencies and in particular those associated with LTE and 4G telecommunications in the region of 1 GHz and above, inherent problems have been found with historically employed interconnections that lead to distortions and impairments to the transmitted signal generically termed PIM. This invention relates to creation of a connector system that separates the mechanical connection features from the forward and return transmission path components by use of non-conductive connector bodies and WaveWay a carefully shaped constrained linear signal path with low resistance and capacitance mating surfaces limiting parallel path distortions and smoother shapes to limit 3rd harmonic and other distortions and lower pressure contact requirements to provide at least equivalent PIM performance to conventional (Continued)

connectors at lower frequencies ~800 MHz and improved PIM performance at 1 GHz and above.

20 Claims, 9 Drawing Sheets

(51) Int. Cl.
*H01R 13/6592* (2011.01)
*H01R 13/56* (2006.01)
*H01R 103/00* (2006.01)
*H01R 9/05* (2006.01)

(52) U.S. Cl.
CPC ..... *H01R 13/6592* (2013.01); *H01R 9/0503* (2013.01); *H01R 2103/00* (2013.01)

(58) Field of Classification Search
CPC ..... H01R 13/5216; H01R 13/5219; H01R 13/56; H01R 13/658; H01R 13/6584; H01R 13/6592; H01R 13/6596; H01R 24/40; H01R 43/042; H01R 9/0503; H01R 9/0512; H01R 9/0518; H01R 9/0521; H01R 9/0524
See application file for complete search history.

(56) References Cited

U.S. PATENT DOCUMENTS 5,354,217 A * 10/1994 Gabel ..... H01R 24/564 439/583
5,911,599 A 6/1999 Masuda
6,019,635 A * 2/2000 Nelson ..... H01R 9/0521 439/583
6,802,739 B2 * 10/2004 Henningsen ..... H01R 9/0521 439/584
6,939,169 B2 * 9/2005 Islam ..... H01R 9/0521 439/578
7,311,554 B1 * 12/2007 Jackson ..... H01R 9/0521 439/584
7,347,729 B2 * 3/2008 Thomas ..... H01R 4/5033 439/583
7,351,101 B1 * 4/2008 Montena ..... H01R 9/0521 439/584
7,462,069 B2 * 12/2008 Studerus ..... H01R 13/5205 439/583
7,635,283 B1 * 12/2009 Islam ..... H01R 9/05 439/583
7,637,774 B1 * 12/2009 Vaccaro ..... H01R 9/0521 29/828
7,690,693 B2 * 4/2010 Moner ..... F16L 25/009 285/247
7,736,181 B1 * 6/2010 Benevento ..... H01R 9/0518 439/585
7,934,954 B1 * 5/2011 Chawgo ..... H01R 9/0524 439/578
8,038,472 B2 * 10/2011 Montena ..... H01R 24/564 439/578
8,047,870 B2 * 11/2011 Clausen ..... H01R 9/0524 439/578
8,113,878 B2 * 2/2012 Clausen ..... H01R 24/564 439/584
8,157,589 B2 * 4/2012 Krenceski ..... H01R 9/0524 439/578
8,177,582 B2 * 5/2012 Amidon ..... H01R 9/05 174/68.1
9,166,306 B2 * 10/2015 Montena ..... H01R 9/0524
9,172,156 B2 * 10/2015 Nugent ..... H01R 9/0518
9,270,046 B2 * 2/2016 Natoli ..... H01R 13/5205
9,772,348 B2 * 9/2017 McGrath, Jr. ..... H01R 9/0521
9,806,473 B2 * 10/2017 Kim ..... H01R 24/40
9,941,609 B2 * 4/2018 Paynter ..... H01R 9/0521
10,177,469 B2 * 1/2019 Wu ..... H01R 9/0527
2005/0023832 A1 * 2/2005 Edler ..... F16L 25/0036 285/354
2013/0244484 A1 * 9/2013 Wild ..... H01R 24/564 439/578

OTHER PUBLICATIONS

Written Opinion of the International Searching Authority dated Feb. 4, 2016 for corresponding International Application No. PCT/GB2015/000246, filed Aug. 18, 2015.
International Preliminary Report on Patentability dated Oct. 21, 2016 for corresponding International Application No. PCT/GB2015/000246, filed Aug. 18, 2015.
European Examination Report dated Feb. 13, 2020 for corresponding EP Application No. 15774946.6.

* cited by examiner

LOW PIM PASSIVE CONNECTION SYSTEM FOR CELLULAR NETWORKS

BACKGROUND

Coaxial Radio Frequency (RF) connectors are used to terminate coaxial cable in order to act as an interface to conjoin multiple cables and cables to system equipment.

RF connectors come in a variety of dimensions and shapes for different powers, frequencies and applications, with most conforming to published standard dimensions to facilitate inter compatibility of different manufacturers' parts. Two such generally high power and frequency connector types are designated as "7-16" connectors and 'N Type' connectors.

A specific application for the 7-16 and N Type connectors has been in cellular communications networks to terminate 'Jumper Cables' to interconnect between infrastructure cables such as 'Feeder Cables' and to system equipment such as receiver and antennae systems and as an interface on the equipment itself. Feeder cables are rigid and larger such as Spinner LF 1⅝"-50. Jumper Cables are generally smaller and more flexible such as Hansen RF50 ½" S.

Said cables, particularly Jumper Cables are known to Generate Passive Inter Modulation. 'PIM' describes the mathematical calculation of interference incurred in mixing one or more desired signals that result in a family of undesired signals; which in cellular telecommunications may interfere with the Base Receiver and result in desired signal losses and dropped calls. PIM represents a significant problem encountered with high frequency networks. The term is actually now taken to mean any disturbance or corruption of the original signal that includes $3^{rd}$ harmonic modulation through mixing via introduced multiple signal paths, noise, reflections through impedance mismatches and a variety of other distortions that can affect signal integrity. The introduced $3^{rd}$ harmonic side bands of the higher allocated centre frequencies easily can fall in the same place as other allocated centre frequencies within the spectrum and thus cause interference, distortions and noise to cascade through the spectrum creating what is termed as "spectrum filling" which reduces the effective Signal to Noise Ratio (SNR), slowing data rates and causing 'dropped' signals and in extreme cases effectively preventing or severely restricting use of entire sections of bandwidth Coaxial connectors terminating jumper cables particularly the 7-16 connector make the major contribution to PIM generated from 'Jumper Leads'. Such connectors are constructed from multifarious contiguous metal parts. The outer contiguous metal parts endow the connectors with an electromagnetic screen and return transmission pathway but the form factor and junctions of the contiguous metal parts cause non-linear and parallel path signals to be generated. The connection 'Locking Nut' which forms part of the return transmission channel typifies the problem, it must revolve around other parts of the transmission channel therefore without the application of significant compression forces which may in themselves be deleterious the assembly can only result in capacitive couplings at best. Moreover the screw threaded interior form of the locking nut causes arcing and further capacitive effects which all add to the problems of PIM.

Importantly the published standard for 7-16 General Purpose Connectors allows for up to 1 mm tolerance in some dimensions and aggregated with poor generic design and manufacturers individual tolerances provides too much variation in connector "form, fit & function" within the overall expected "standard" design as supplied by different manufacturers. Said variability presents a major inter-compatibility problem between different manufacturers' connectors in respect of electrical parameter performance that in some cases cannot be reconciled and as a result connections on any project must usually be limited to one manufacturer which has commercial implications. Even connectors from the same manufacturer require compression intensity achievable only by the use of sometimes inconvenient wrenches or other tools to create torsion of sufficient force to create only a moderately effective low PIM signal transition between male and female connectors. But such high torsion forces can result in flaking of electroplating the consequence of which is signal reflections and disturbances and in any event high torque cannot in of itself fully mitigate completely the inherent poor contact that creates higher than desired resistances and insertion losses that contribute to PIM Significant magnetic field effects, signal harmonics and harmonic resonances from vibrations are also generated within the bulk of the connector bodies' conjoined metal parts and plating, all contributory factors to PIM. The metal structure is susceptible to noise and other detrimental environmental effects and if un-isolated is disposed to oxidisation and subsequent corrosion which is deleterious to electrical transmissions and a significant contributory factor to PIM, it is for this reason that most cables and Jumper Leads are terminated in factories dedicated to the process. The metal connectors are generally covered in a moulded shroud to prevent water ingress and oxidisation, but over-moulding cannot be effected on the connector locking nut which is a fundamental component of the return transmission path so notwithstanding metal and thermoplastic are not best suited to gas tight seals, no matter how competent the over moulding, corrosion is inevitable and corrosion based PIM gets worse as the installation ages.

Factory assembly of Jumper leads also causes its own problems in field installation; standard length, non-bespoke cables generally need to be bent or coiled to fit and cable bending especially close to the connector causes joints to flex and adds to the assault on the signal integrity and hence PIM problems. Moreover the excess of cable is generally difficult to manage and may become loose causing vibrations and 'strike' noise to be introduced in the signal path which can resonate through the transmission channel and is a further source of potential PIM.

Said connectors were designed in the 1940's primarily for terminating 'Radio Guide'* Mil Spec* equipment and cables with straight braided and or foil type electromagnetic screens. Efficient deployment on more recently introduced broadcasting cables with undulating waveform design electromagnetic screening is less efficient and field termination in particular mostly results in poor termination and capacitive couplings, moreover it cannot result in the gas tight assembly necessary to resist ingress and corrosion.

Connector manufacturer mutability, component mutability, corrosion, poor mating features, multi component transmission paths and variability in assembled connector dimensions cause resistance, reflections, capacitive couplings, signal hysteresis, harmonics and Microphonics, all contributory factors to PIM.

Upon the introduction of 4G operating standards using wider frequency bandwidth allocations from 800 MHz through to 2.69 GHz in the UK (depending on the operator) many network systems employed for 3g have been upgraded by deploying higher specification transmission and receiver equipment. The upgraded systems often use the same infrastructure cabling systems and connectors. Even when entirely new systems are installed the cable, connectors and Jumper leads deployed are still frequently similar to or the same as those deployed in systems up to and including 3g standards but these traditional connective products are extremely limiting in the latest and future environments and in delivering on burgeoning demands for low PIM bandwidth that some present and future applications require.

STATEMENT OF INVENTION

A combination of methods incorporated into a connector device intended to terminate cables that will reduce cable induced PIM. The connector device will incorporate methods that provide better electrical connectivity and improved mechanical strength of the signal paths particularly the Electromagnetic Screen and Return Path circuit and to reduce parallel path signals and electromagnetic distortions by providing a linear signal passage without multiple transition points, threaded screw forms and other sharp features that cause PIM. The connector further Mitigates PIM by decoupling mechanical and electrical retention of connector to cable using a Locknut with Lock and Seal Ring. The step change improvements are made possible by incorporating a constrained electromagnetic screen 'WaveWay' which carries return transmissions and is formed from a single element independent uni-structure that when conjoined to its opposite gender may be isolated from all other transmission paths and sources of electrical interference within and or without the Connector Housings throughout its entireness and is electrically independent to any substrate with the ability to carry signal or interference within or without the connector. The WaveWay increases microscopic adhesion within the Electromagnetic Screen and Return Path of cable and connector at transition points by employing a cooperating Conical Mating Feature that reduces capacitive coupling and unwanted corrosive material ingress along with an improved undulating design feature that cooperates with standard commercial cables.

PIM caused by Microphonics have been mitigated by use of Connector Housings formed from dampening composite and compound materials such as ABS and vulcanised rubber.

DESCRIPTION

This patent relates to the reduction of potential sources of PIM in Jumper Cable connections deployed in cellular communications and particularly the RF connector components incorporated therein, such as but not limited to N type and 7-16 connectors by preferably incorporating composite polymer, ceramic or vulcanised rubber based non-metallic Connector Housings and associated components that contain very little or no magnetic iron or other ferro-magnetic impurities currently causing problems in traditional metallic connectors. The preferred non-conductive non-ferrous materials do not oxidise, display no magnetic or harmonic properties and cannot propagate electrical signals, pulses or waves thereby limiting transmissions to defined, perfectly linear and constrained unified pathways that are isolated from all sources of electrical interference thus inhibiting interference and multiple signal pathways, including through the deleterious 'Locking Nut' and obliging such transmissions to follow the prescribed constrained pathways. Since the preferred materials of the Connector Housings and associated parts have virtually no electrical conduction properties they display effectively no signal hysteresis response to environmental, electromagnetic and other interference, contrariwise they have a dampening effect on eddy currents mechanical vibrations, and microphonic and harmonic sources of PIM.

The described linear return transmission path also serves as the electromagnetic screen and may preferably be provided in a single element form, the 'WaveWay', whose structure provides a constrained, single linear signal pathway that that is essentially formed in the inverse to the form of the undulating Electromagnetic Screen and Return Path of broadcast cable and may be formed on the inner surface of the Connector Housing or as an independent component. Conductivity for the WaveWay may be affected by selective coating on the non-conductive Connector Housings. Reproducing the undulating form of the broadcast cable in the substrate of the connector increases empathetic surface connection area between the 'WaveWay' and cable and prevents microscopic separation of the transmission pathway thus forming a harmonious unification of conjoined surface area that promotes enhanced electrical performance between conjoined surfaces and thereby enhances efficiency of signal transition from cable to connector. The single element 'WaveWay' further provides a perfectly linear transmission path through the connector that prevents the parallel transmissions, resistances and distortions that are created by multiple conjoined parts thereby delivering the enhanced signal to the inter-mating face of the 'WaveWay' with minimum distortion and loss.

Male and Female WaveWay inter-mating surfaces may preferably incorporate a Conical Mating Feature each in the inverse design and co-operative to its opposite gender thereby bestowing a more ergonomic mating surface which requires very little compression or torque in consequence preventing stressed connections whilst increasing conjoined surface area thereby increasing the bond and electrical performance between the two WaveWay genders without applied high compression which can be a cause of other sources of PIM. The said Conical Mating Feature may incorporate one part of its circumference area that is compatible with established connector manufacturer dimensions thereby allowing the return transmission path to establish an electrical connection with all other manufacturers connectors in addition to the connector described herein and facilitate the processing of electrical signals, impulses and waves between other connector designs and the subject connector of this patent application.

When assembled to cable, the empathetic undulating design of the WaveWay forms an exceptional union or bond to the cable through the interconnected undulating corrugations that unless disassembled requires such equivalent forces as are necessary to destroy the physical form of the cable and or connector to break thereby imparting an exceptional durability to the connection.

Alternatively the required Electromagnetic Screen and Return Transmission Path may be provided via an independent 'WaveWay' inserted into the Connector Housing that co-operates with the undulating form of the cable and may be selectively coated with conductive polymers or any other conductive material. Said 'WaveWay' may typically be manufactured of the same or similar material as the Connector Housing or from metal or any suitable conductive or none conductive substrate that may be coated to provide electrical conduction thus similarly constraining returned transmissions to a single linear pathway that prevents multiple transmission paths and forms an empathic almost indestructible bond between connector, 'WaveWay' and cable.

Through use of relatively thin skin-effect coatings signal paths may be tightly constrained compared to solid large cross-sectional conductor components. Said constrained pathways reduce PIM by reducing signal phase distortions, harmonic resonances, microphonic effects and unwanted multi-path signal mixing. Said designs facilitate low return path resistances and improve signal integrity and amplitudes throughout the system as well as reducing I2R losses and provide lower damping time constants all of which are essential for lowering PIM in high efficiency, high-speed network data transmission.

Preferred design of the 'WaveWay is preferably formed of one piece monocoque or uni-structural design but may also be a clam-shell design with WaveWay Adaptor and the aforesaid Connector Housing designed to fit over it and protect it from environmental effects and interference. The Undulating Waveform design feature of the WaveWay may preferably be formed in exactly the inverse dimensions and co-operative to the undulations of the broadcast cable to which it is designed to be conjoined thereby increasing the conjoined surface area between the cable and the connector when assembled and in so doing increasing the microscopic adhesion and efficacy of the electrical performance between the two in addition to forming a physical and electrical connection that can only be broken upon disassembly or by such forces as are necessary for destruction of the cable and or connector.

Composite and compound plastic or ceramic materials such as glass filled ABS or similar materials that impart robustness, stability and accuracy of shaping may preferably be employed in the construction of the Connector Housing and such other materials as may benefit a desired application may preferably be introduced such as but not limited to vulcanised rubber to provide an element of flexing to lower torsion and refraction stresses and hydrophobic matter to provide fluid repulsion at areas vulnerable to ingress. Such materials may be injection moulded to create complex shapes at lower cost without the currently necessary machining and assembly of multiple metal parts commonly used in conventional connectors, the combination of which are in any event inefficient and generate their own resistances and electrical problems. Moreover the preferred lightweight composite materials display vibration dampening and attenuating qualities which help to reduce PIM.

The relatively poor forward transmission path contact co-operation at signal contact areas may be improved by incorporating a Contact Closing Collet circumventing the male contact to stop the female contact 'splaying' or relaxing its grip over time and to constrain the female contact thereby to prevent microscopic separation between the two and increase contact area in a stress free manner, in so doing increase signal efficiency by decreasing capacitive couplings, reflections and resistances.

The WaveWay described herein and the Contact Closing Collet prevent microscopic separation within the forward and return transmission paths providing the connector with increased tolerance to flexure thereby imparting far greater tolerance to environmental stresses such as striking and movement of Jumper leads and conjoined cables and taken together with the vibration dampening effect of the Connector Housings and associated components reduce connector and channel generated PIM considerably.

Some broadcast cables incorporate a displaced non-axial centre conductor to improve flexibility therefore in order to ensure centrality of said conductor when conjoined with the Connector Dielectric said Connector Dielectric may incorporate a Dielectric Contact Guide that ensures concentricity of the conductor at the WaveWay inter-Mating Feature.

The Connector Housing may preferably incorporate super Hydrophobic matter within its substrate or be factory or field treated with a super hydrophobic nano coating to impart water repellent qualities to areas vulnerable to ingress thereby providing a method of repelling fluid. An enveloping watertight Cable Locknut with Cable Lock and Seal "O" Rings may also be incorporated at the rear cable mating part of the connector housing not only to prevent ingress but also to decouple the WaveWay from retention stresses and Male Connector Housing Nose and Locknut Seal Silicone "O" Rings at the forward connector mating areas of the connector together with a Male Connector Housing Locknut Retaining Ring to prevent ingress. Further options to improve ingress resistance may include the incorporation of further seals and Silicone "O" Rings or an ingress resistant Boot either as a separate entity or as an extension of the Compression Cap thereby to ensure the connector has a gas tight seal to the cable and is impervious to ingress. A further or alternative improvement to IP ratings may be the placement of a water resistant shroud, boot or over-sheath to the exterior of the connector for certain applications. Water resistant oils or other water resistant material may also be applied to the exterior parts of the connector at the more vulnerable areas to ingress such as the Male Connector Locknut and Cable Locknut conjoining areas.

The preferred low compression coupling and Signal Transition Area designs described herein provide robust high microscopic adhesion with such low compression necessary to provide proficient low PIM signal transit that intercoupling of connectors may be effected by hand without wrenches or other torsion or compression inducing tools. A preferred embodiment of the connectors incorporates a hand grip 'Handigrip' design to be configured into the Male Locking Nut and Female Connector Housing to assist in effecting a rapid and convenient quick-twist method of conjoining connectors. The quick-twist feature imparts a rapid and efficient tool less method of field termination that taken together with the preferred methods of providing a low compression, low signal distortion, gas tight fit and fluid repulsion permits hand assembly of bespoke cables in the field of exceptional durability and high PIM performance that bestows an almost indestructible union of cables and connectors on the assembly in addition to galvanic corrosion prevention of the transmission channels.

The connectors described herein provide a method of hand manufacturing low PIM high performance Feeder and Jumper cables in the field so competently there is no requirement for Feeder and Jumper Cables to be factory manufactured remotely thereby allowing bespoke Cables to be made in the field of the exact length required for the individual site and application thus eliminating PIM caused from loose cable.

The described connector may not conform to all published standard dimensions of the general standard of connectors such as but not limited to 7-16 but the Conical Mating feature nevertheless provides a progression of inter-mating dimensions that creates a method of bestowing a functional fit to all major manufacturers connectors and may conjoin with those connectors to provide a conduit for electrical signals, impulses or radio waves. Alternatively perfect compatibility with other manufacturers connecters can be achieved by the incorporation of an independent bespoke WaveWay Converter that may provide a Mating Feature of the exact dimensions to those of any specified manufacturer thereby to provide the WaveWay connector with the ability to be conjoined with any specified manufacturers connector in order to create a lower PIM coupling to that of said specific manufacturers connector as if the manufacturers own connectors had been coupled together and further makes the WaveWay connector the only known connector that is interchangeable with any other manufacturers connector without any deleterious effect on signal transit or performance between the two connectors.

DESCRIPTION OF DRAWINGS

List of Figures

KEY TO NUMBERS

1. Cable Locknut
2. Female Connector Housing
3. Male Connector Locknut
4. Male Connector Housing
5. Cable Locknut
6. Female Connector Dielectric
7. Male Connector Dielectric
8. Cable Seal "O" Ring
9. Cable Seal "O" Ring
10. Cable Lock & Seal Ring
11. Female Contact
12. Female Connector WaveWay
13. Contact Closing Collet
14. Male Contact
15. Male Connector WaveWay
16. Cable Lock and Seal Ring
17. Cable Seal "O" Ring
18. Cable Seal "O" Ring
19. Male Connector Housing Nose Seal "O" Ring
20. Male Connector Housing Locknut Seal "O" Ring
21. Male Connector Housing Locknut Retaining "O" Ring
22. Female Connector WaveWay Undulating Waveform Shape
23. Male Connector WaveWay Undulating Waveform Shape
24. Female Connector WaveWay Conical Mating Feature
25. Male Connector WaveWay Conical Mating Feature
26. Female Connector Dielectric Contact Guide Aperture
27. Male Connector Dielectric Contact Guide Aperture
28. WaveWay Adaptor
29. Longitudinally Split Male WaveWay
30. Corrugated Cable Screen
31. Cable Forward Path Conductor
32. Longitudinally Split Female WaveWay
33. Clamshell design Splice Housing
34. Cable Compression Locknut
35. Male Locking Latch
36. Female Locking Latch
37. Splice Housing O Ring
38. Cable Compression Locknut "O" Ring
39. Upstanding Registration Spigots
40. Recessed Registration pockets
41. Upstanding Sealing Feature
42. Recessed Sealing Feature
43. Converter WaveWay Male Step Feature
44. Dummy Female Reference Part for fit checking
45. Dummy Male Reference Part for fit checking
46. Living Hinge
47. WaveWay External Undulations
48. Splice Housing Smooth Internal Body

A PREFERRED EMBODIMENT FORM

Figure 3:
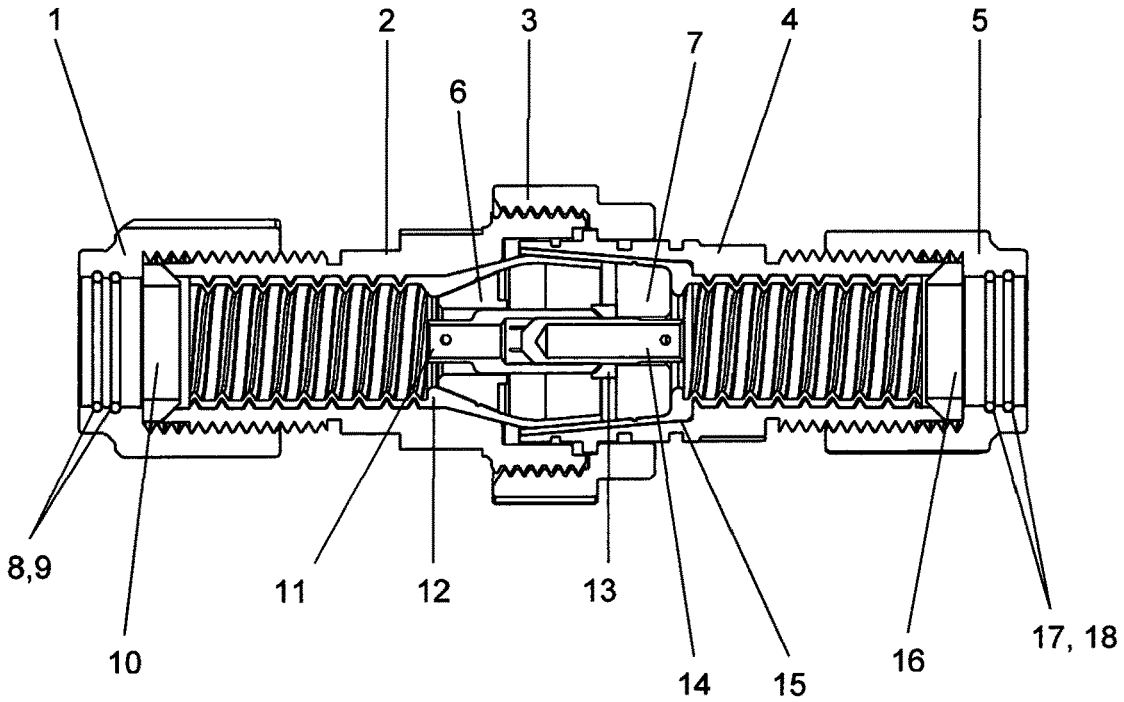
FIG. 3. Section View of Assembled Connector on X-X
Figure 4:
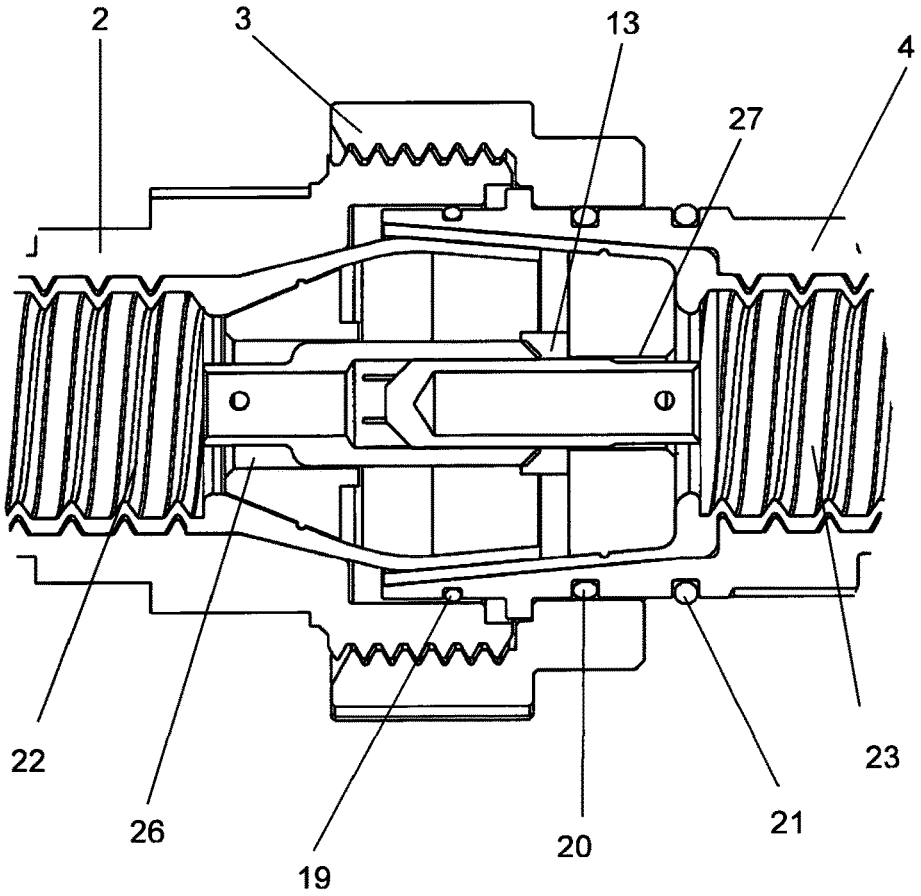
FIG. 4. Detail of Section View on X-X of Mated Connector
Figure 7:
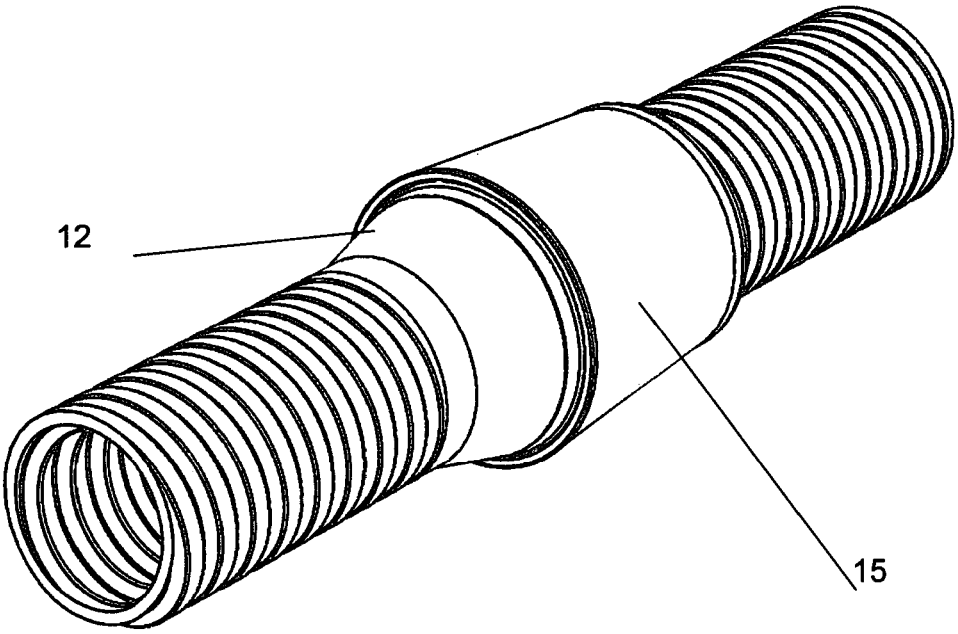
FIG. 7. Interconnected Male and Female WaveWays
Figure 9:
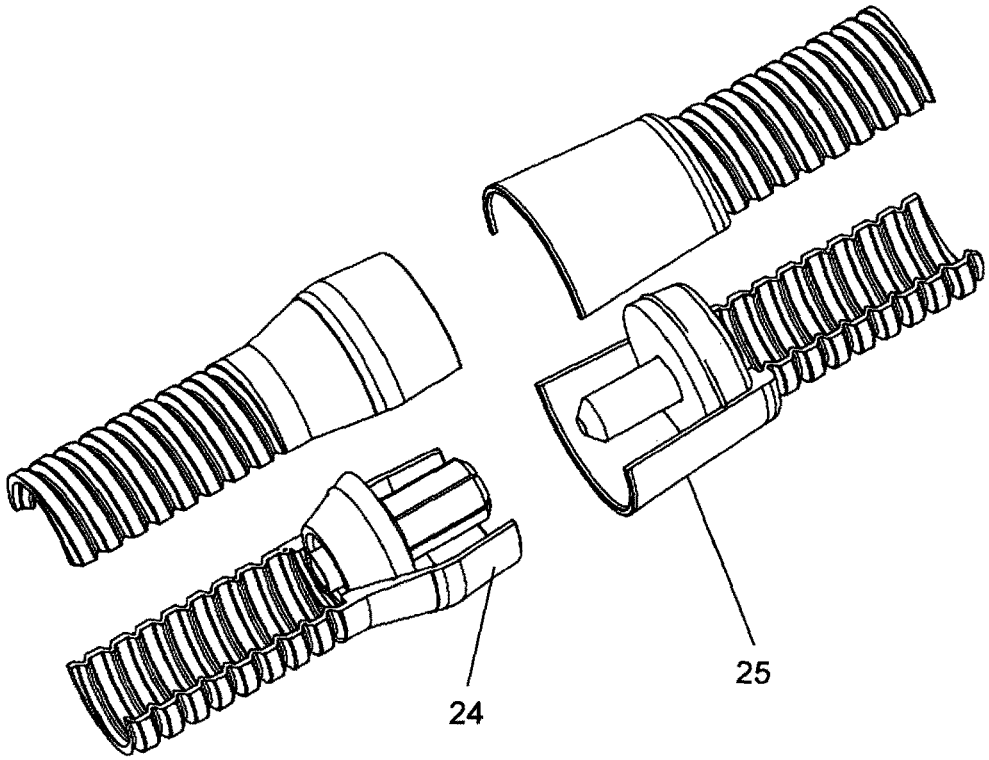
FIG. 9. ¾ View of Unmated Split Clamshell WaveWays

The Figures show preferred embodiment forms of the new connector that incorporates a Connector Housing as shown in FIGS. 1, 2, 3, 4, 6 Nos. 2, 4 that is essentially manufactured from a non-metal substrate such as plastic, ceramic, glass or rubber or a composite thereof or any other non-metallic material and an Electromagnetic Screen and Return Signal Path FIGS. 3, 7 Nos. 12, 15 'the WaveWay' formed essentially in a spiral Undulating Waveform Shape FIG. 4 Nos. 22, 23 at the rear where it conjoins and co-operates with the similar undulating shape of the cable, and at the front with a Conical Mating Feature FIG. 9 Nos. 24, 25 where it conjoins and co-operates with a connector of its opposing gender. The described WaveWay may be moulded into the interior of the non-metal Connector Housing structure and be selectively coated with any material displaying the desired electromagnetic and conductive qualities.

There will now be described further embodiments of the WaveWay;

Said WaveWays may alternatively preferably be formed of separate components to the Connector Housing structure as shown in FIG. 7 constructed from any material with desired electromagnetic qualities such as copper and or any other type of material conductive or non-conductive selectively coated with a material that has the desired electromagnetic and conductive qualities.

Figure 5:
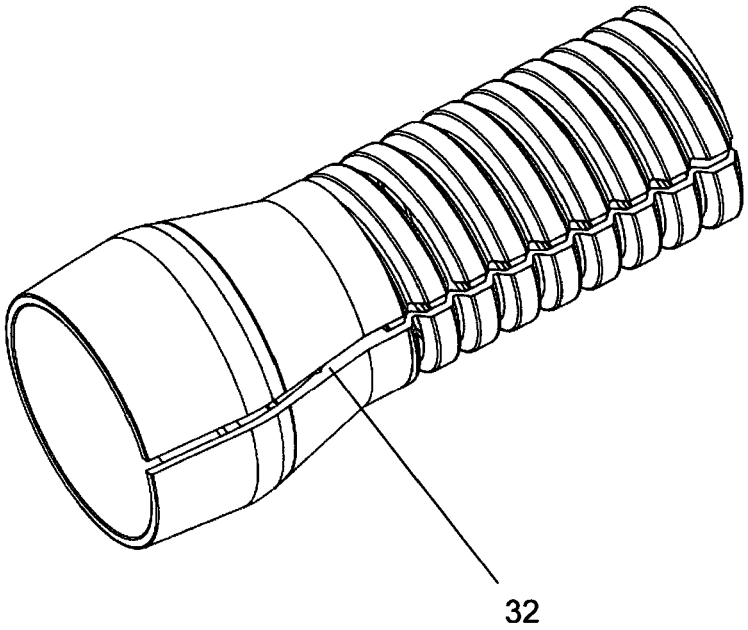
FIG. 5. Split Female WaveWay
Figure 6:
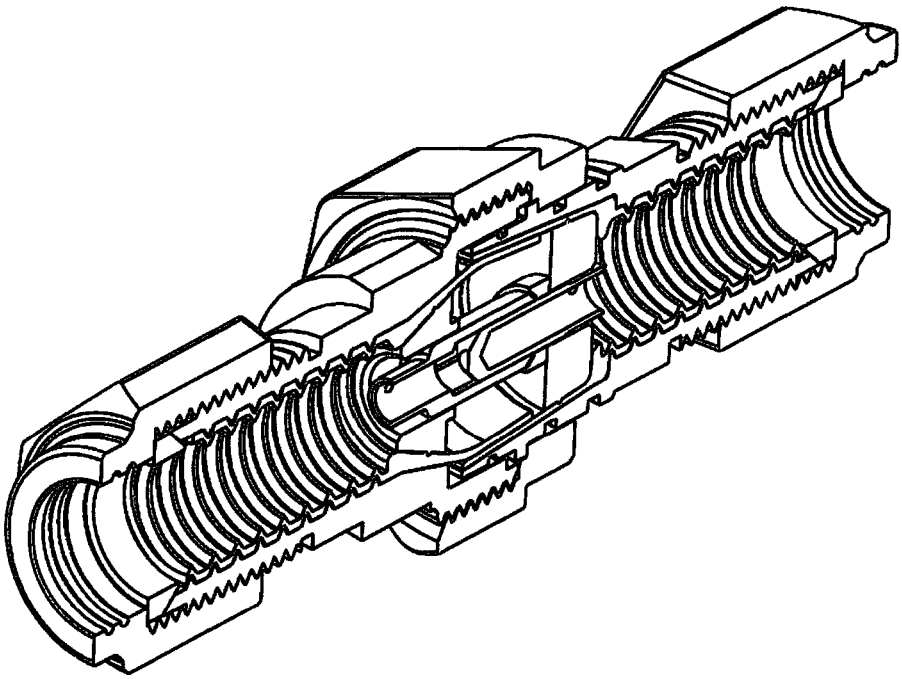
FIG. 6. ¾ View of Assembled Connector Sectioned on X-X
Figure 10:
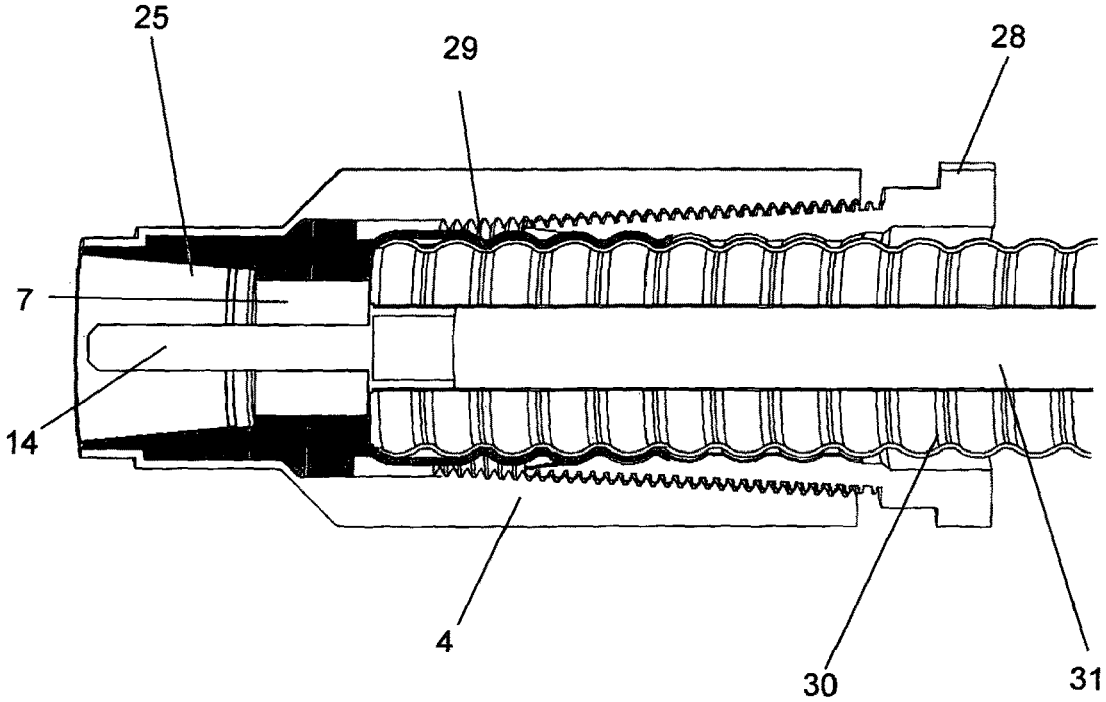
FIG. 10. Section View of Male Connector for Ribbed Undulating Cable. WaveWay in Black WaveWay adaptor shaded FIG. 11. Exploded Part Section View of Male Connector for Ribbed Undulating Cable. Cable removed for clarity. WaveWay in Black. WaveWay Adaptor shaded FIG. 12. Splice Connection Housing ¾ View with Cable Nuts FIG. 13. Open Splice Connection Housing ¾ Exploded View Showing Main Components FIG. 14. Open Splice Connection Housing ¾ Exploded View FIG. 15. Male WaveWay Convertor Assembly FIG. 16. Male WaveWay Convertor Assembly internals ¾ Section FIG. 17. Section View of Male WaveWay Convertor Assembly—Reference Mating Parts in Black FIG. 18. Section View of Female WaveWay Convertor—Reference Mating Parts in Black

A further preferred embodiment of the described WaveWay may incorporate at least one Longitudinal Split FIG. 5 to allow initial expansion for fitment over a non-spiral ribbed form of Cable Electromagnetic Screen and Return Signal Path FIG. 10 No. 30 that may be radially compressible by a compression tool to assure maximum conjoined surface area between the two. Alternatively compression and fit to the Connector Housing may be effected by the fitment of a WaveWay Adaptor FIG. 10 No. 28 that may incorporate a conically shaped spiral or threaded exterior which cooperates with the internal design of the Connector Housing to which it may be fitted to unify the structure, seal, protect and assist in forming the compression fit to the cable in order to assure maximum conjoined surface area with the Cable Electromagnetic Screen and Return Signal Path and WaveWay described herein so as to ensure maximum microscopic adherence.

Figure 8:
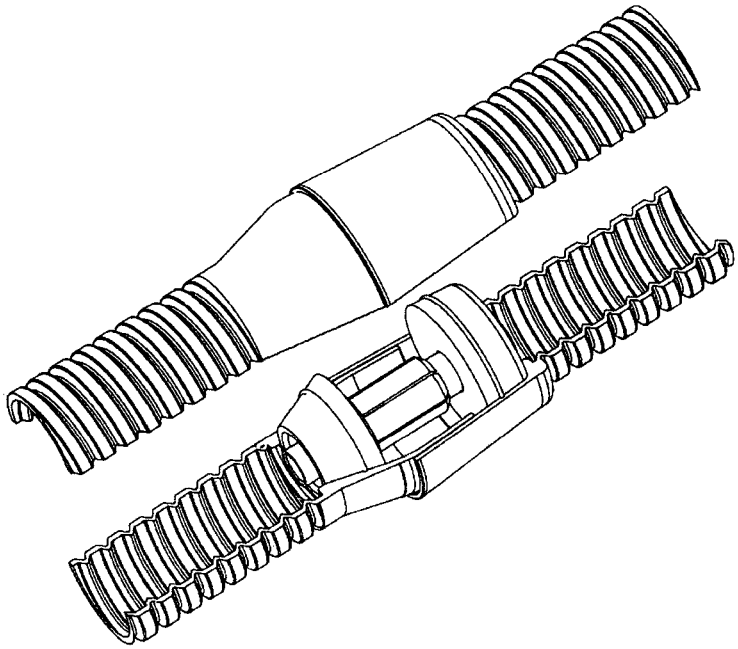
FIG. 8. ¾ View of Mated Split Clamshell WaveWays

A further embodiment of the WaveWay is of 'clam-shell' design as shown in FIGS. 8 and 9 formed essentially in two halves and incorporating described WaveWay Adaptor.

Figure 11:
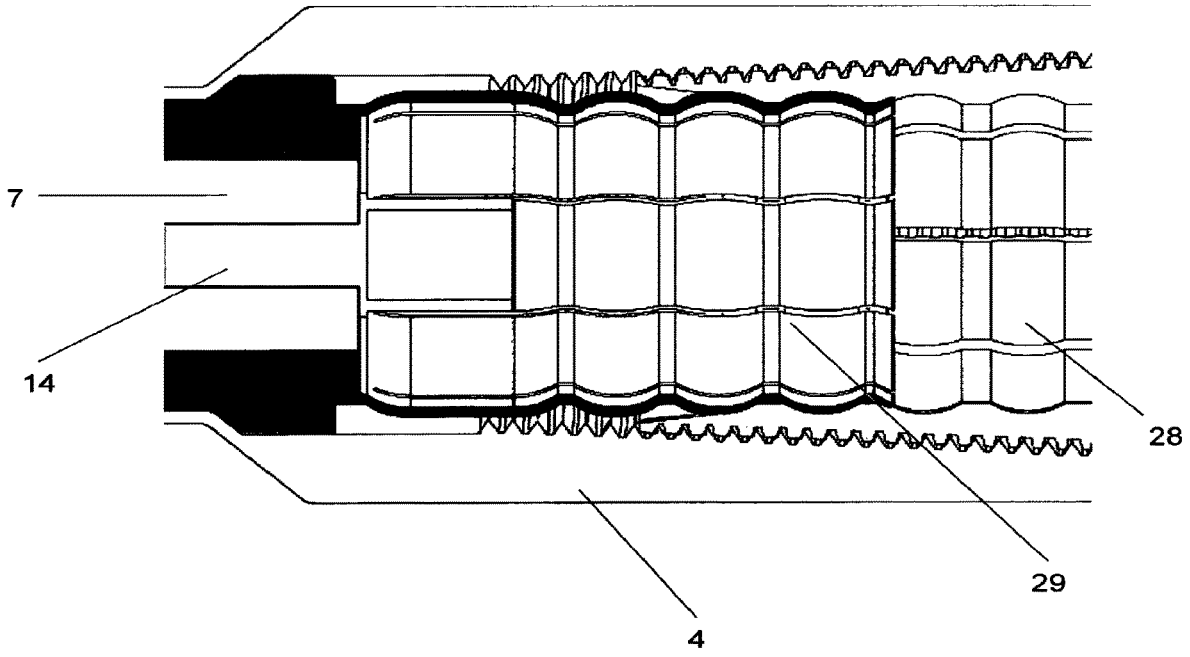

FIGS. 10 and 11 show a Male WaveWay and Adaptor with Longitudinal splits.

Figure 15:
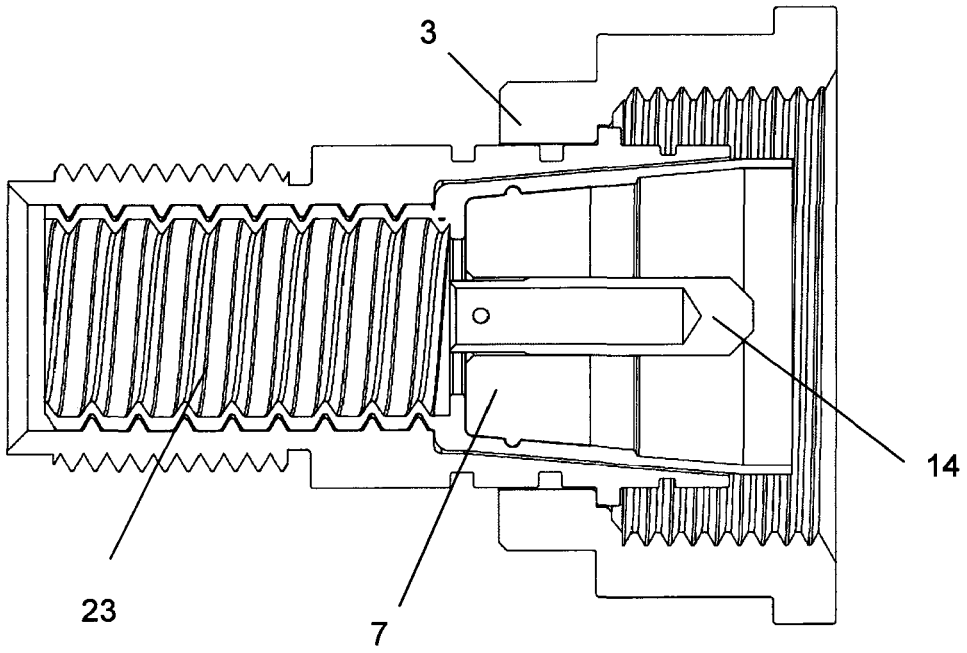
Figure 16:
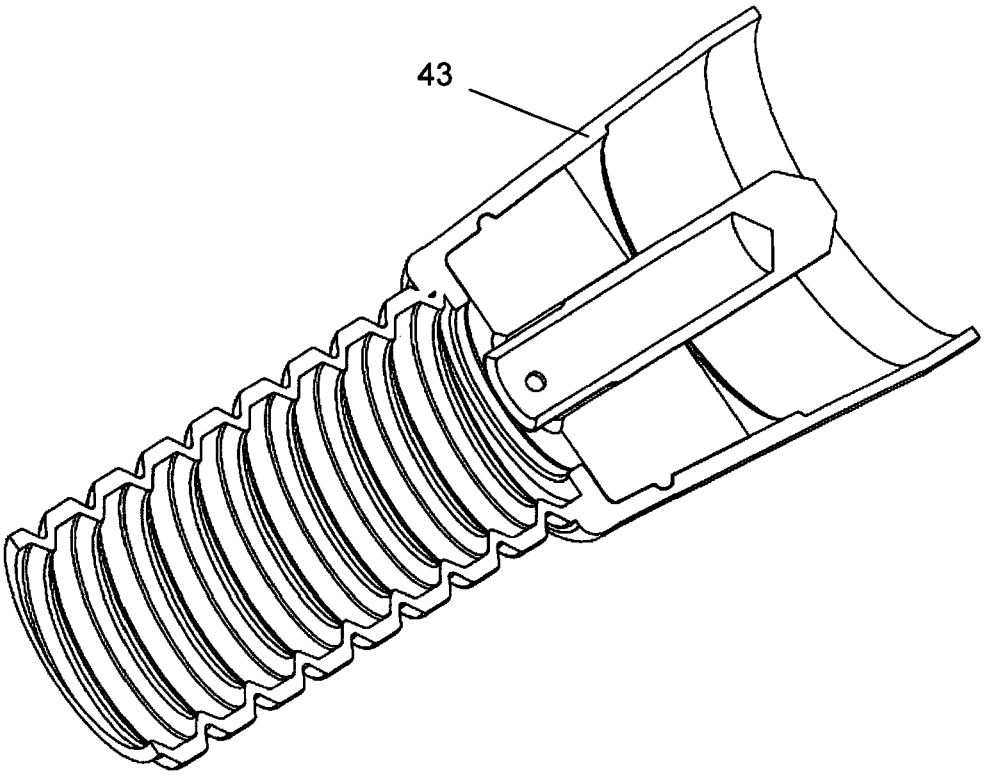
Figure 17:
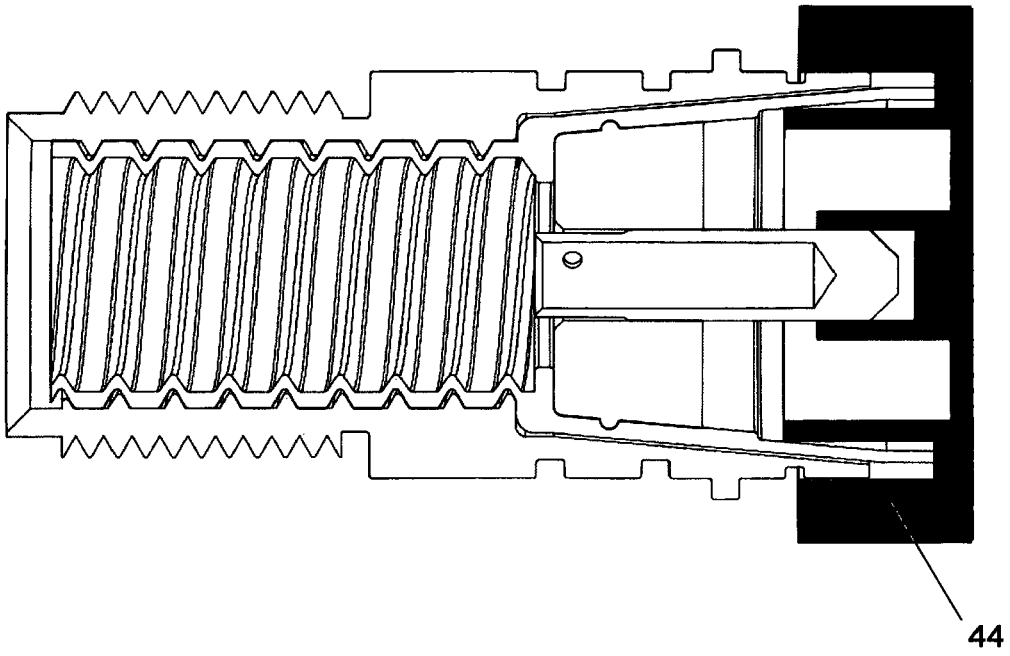
Figure 18:
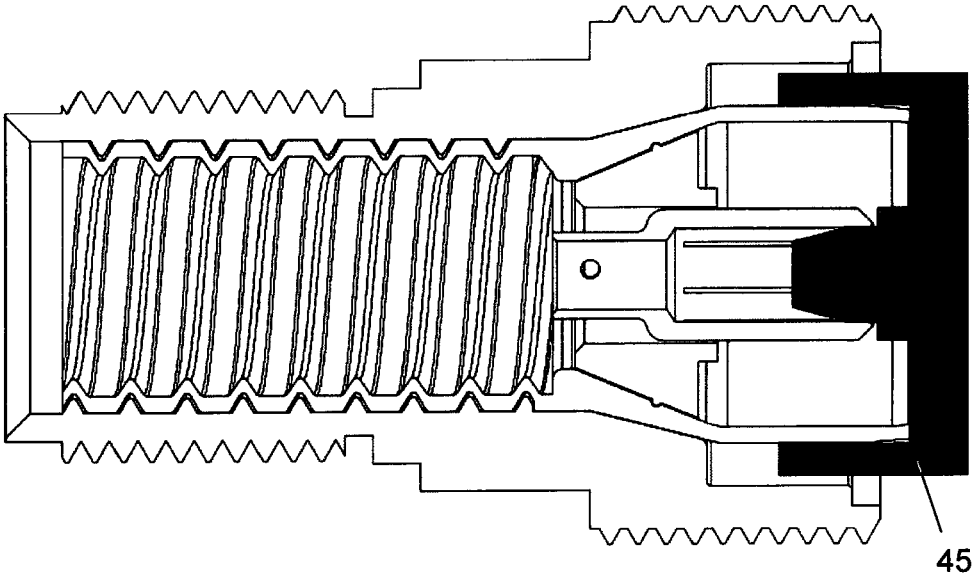

A further embodiment may be a bespoke Convertor WaveWay FIGS. 15, 16, 17 which incorporates a Step Feature within the Male WaveWay FIG. 16 No. 43 and Inter-Mating Features of the exact dimensions of any other manufacturers' connector an example of which is shown in FIGS. 17, 18 Nos. 44, 45 so as to effect perfect compatibility with any other manufacturers' connecters.

A preferred embodiment of the Connector Housings preferably incorporates a Male

Figure 1:
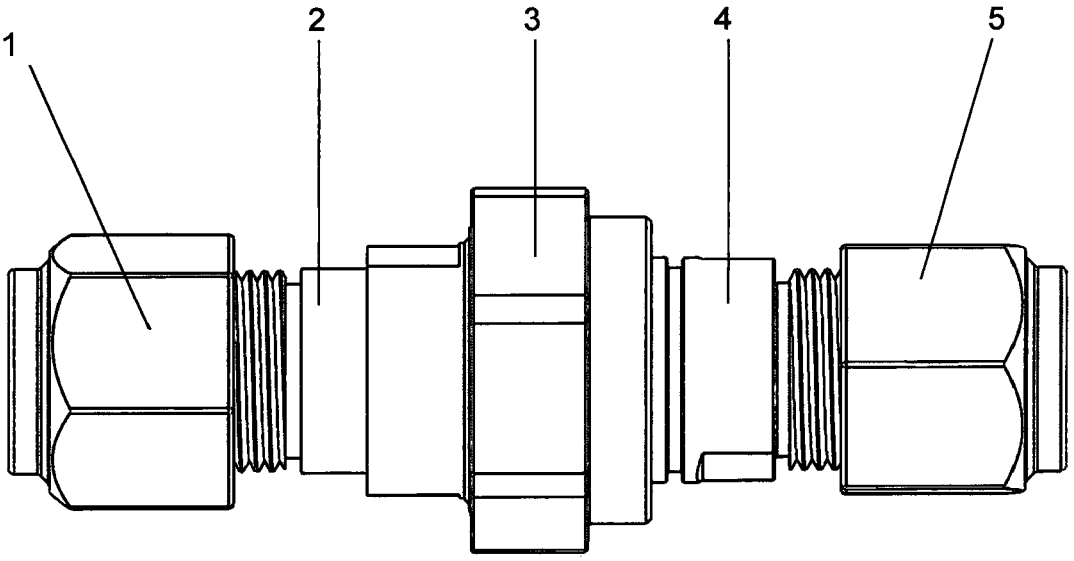
FIG. 1. Side Elevation of Assembled WaveWay Connector
Figure 2:
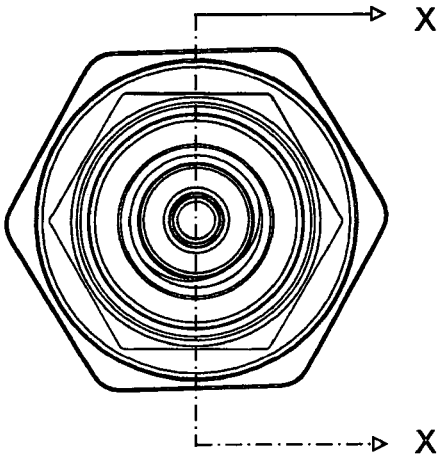
FIG. 2. Male Connector End Elevation Showing Section Line X-X

Connector Locknut FIGS. 1, 3, 4 No. 3 with a helix thread on the interior wall and a co-operating helix thread on the exterior of the Female Connector Housing FIGS. 1, 3, 4 No. 2 to effect an efficient coupling. A preferred embodiment of the Male Locknut and Female Connector Housing may preferably incorporate a hand grip 'Handigrip' of any design in addition to a conventional spanner flat to be configured on the exterior shape in order to effect a rapid and convenient quick-twist method of conjoining connectors.

The Male Contact FIG. 3, 4 No. 14 of the embodiment preferably incorporates an independent Contact Closing Collet FIGS. 3, 4 No. 13 preferably but not necessarily manufactured from a non-metallic substrate designed to fit over the Male Contact and whose function is to constrain the Female Contact FIGS. 3, 4 No. 11 when conjoined and to stop it from 'splaying' or relaxing its grip over time and in so doing to facilitate maximum conjoined surface area and microscopic adhesion when mated with its opposite gender thereby to reduce resistances and capacitive couplings in order to facilitate a more efficient transmission pathway and reduce contributory factors to PIM.

Conversely the Contact Closing Collet may be formed from a metallic substrate or form part of the structure of the Male Contact.

A preferred connector embodiment preferably incorporates Connector Dielectric components FIG. 3 Nos. 6, 7 with a Connector Dielectric Contact Guide Aperture FIG. 4 Nos. 26, 27 to ensure centrality and concentricity of the contacts.

A preferred embodiment preferably also incorporates a rear compression Cable Locknut FIGS. 1, 3 Nos. 1, 5 incorporating at least one compression Cable Lock and Seal Ring FIG. 3 Nos. 10, 16 whose function is to decouple the WaveWay from retention stresses and to seal and protect the connector from water, dust or ingress by any other deleterious material. To ensure a high pressure gas tight seal at these locations each Cable Seal Locknut is provided with at least one Cable Seal O Ring FIG. 3 Nos. 8, 9, 17, 18.

A further preferred embodiment preferably incorporates a Male Connector Locknut incorporating at least one Male Connector Housing Nose Seal "O" Ring FIG. 4 No. 19 and a Male Connector Housing Locknut Seal "O" Ring FIG. 4 No. 20 to seal and protect the connector from water, dust or ingress from any other deleterious material through the connector conjoining joining Locknut.

Figure 12:
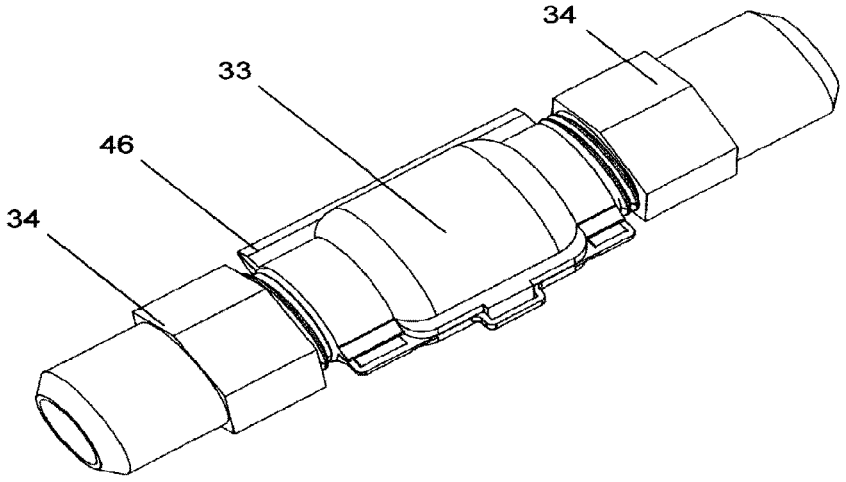
Figure 13:
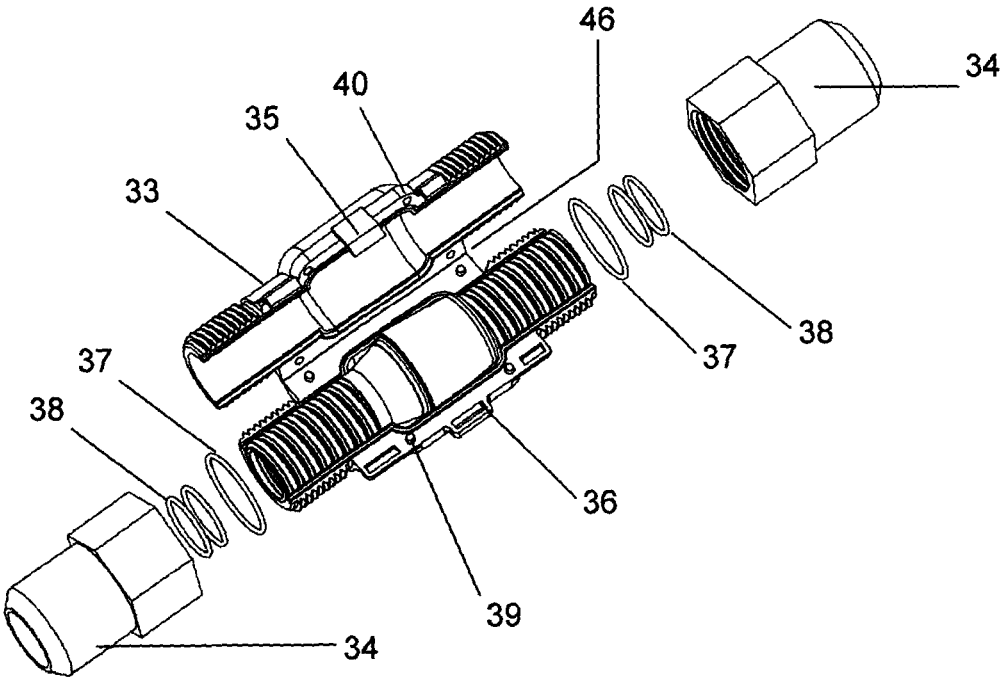
Figure 14:
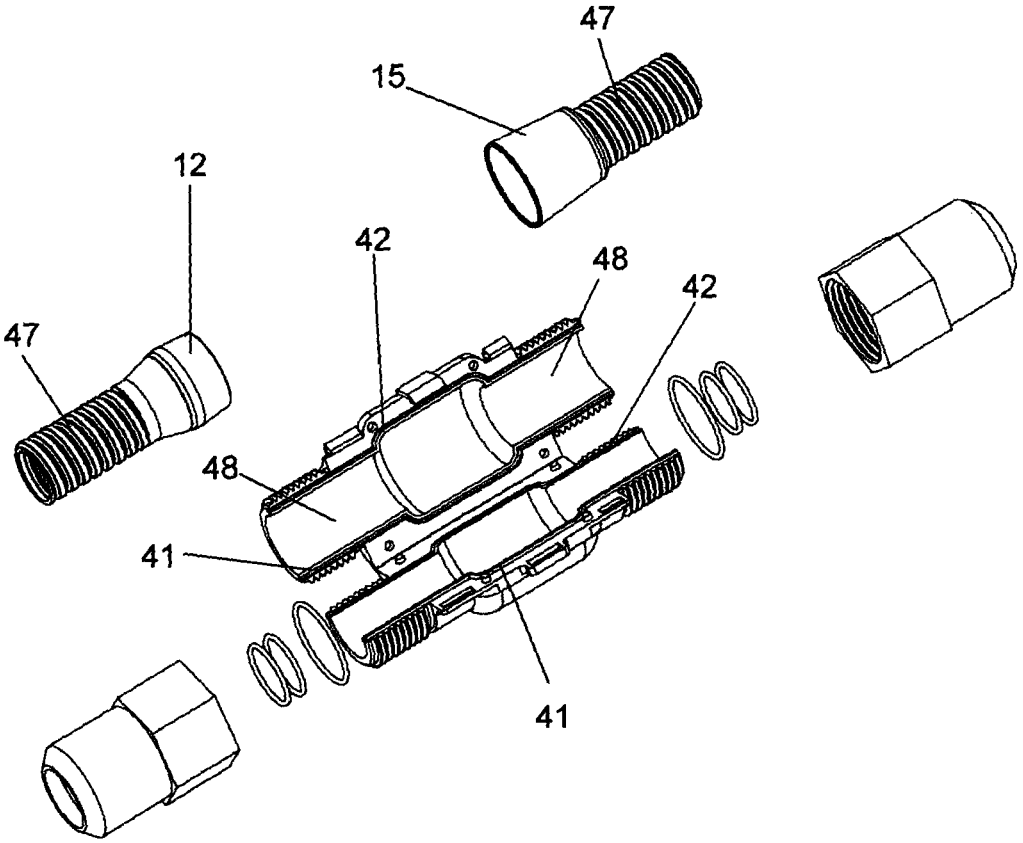

FIGS. 12, 13 and 14 represent an alternative embodiment of the concept using alternatively; a Monocoque WaveWay as depicted in FIGS. 1 through 7 or a Clamshell WaveWay as shown in FIGS. 8 and 9, retained within a Clamshell design Splice Housing with Locking Latches FIG. 13 No. 33 terminated with Compression Cable Locknuts FIG. 13 No. 34.

FIG. 12 shows a closed housing No. 33 with Cable Compression Locknuts and hinge 46. FIGS. 13 and 14 show an open Splice Housing containing Monocoque WaveWay and dielectric components.

The described Splice Housing may preferably exhibit all the same beneficial properties as afore ascribed to the Male and Female Connector Housings and is provided with internal recesses that cooperate with the WaveWay external Mating Features to allow a close radial fit but are smooth FIG. 14 No. 48 to provide a loose sliding fit to the WaveWay external undulations 47. On closing the Splice Housing FIG. 12 Upstanding Registration Spigots FIG. 13 No. 39 cooperate with Recessed Registration Pockets FIG. 13 No. 40 to assist in alignment prevent disturbance of Upstanding Sealing Features FIG. 14 No. 41 and recesses FIG. 14 No. 42 and prevent ingress. A Living Hinge FIG. 13 No. 46 is moulded within the housing to provide a means of opening and closing the connector. Splice Housing Locking Latches FIG. 13 Nos. 35, 36 which may take several alternative forms lock the connector.

Cable Compression Locknuts may then be tightened to compress the WaveWays together to ensure good electrical connectivity.

Cable Compression Locknut O Rings FIG. 13 No. 38 and Splice Housing O Ring FIG. 13 No. 37 are provided to fit inside the Cable Compression Locknuts to provide a gas tight fit.

This embodiment maintains a relatively small diameter such that a simple parallel tubular heat shrink may be applied over the entire assembly and heat shrunk to fit to provide a high integrity atmospheric seal suitable for underwater and similar applications.

All the aforesaid embodiments may incorporate Super Nano Hydrophobic matter to provide the connector with fluid repulsion properties the better to seal and protect the transmission elements from fluid ingress and subsequent galvanic corrosion.

The invention claimed is:

1. An RF coaxial connector for terminating a coaxial cable, the connector comprising:

a connector housing formed of non-conductive material, the connector housing having an internal axial passage extending between first and second ends; and a waveway, defined as being an electromagnetic screening and return path element within said axial passage of the connector housing, the waveway being formed of a single element and having an internal axial passage extending between first and second ends of the waveway, the axial passage of the waveway comprising electrically conductive material and having an undulating internal profile along at least part of a cross-sectional length of the waveway in order to cooperatively connect around an exterior surface of an outer screen conductor of a coaxial cable passing through the first ends in use, the waveway being electrically isolated from the connector housing and providing a constrained return signal path for signals from the outer screen conductor of a connected coaxial conductor.

2. The RF coaxial connector of claim 1, wherein the waveway formed of the single element further comprises a first conductive mating portion, being one of a male/female gender, wherein the first conductive mating portion comprises a tapering wall having a surface shaped so as to cooperatively conjoin with a tapering wall surface of a second conductive mating portion of another connector waveway of the opposite male/female gender, the first conductive mating portion extending adjacent the part having the undulating profile to the second end.

3. The RF coaxial connector of claim 2, further comprising a dielectric component positioned within the first conductive mating portion and supporting a male/female contact for connection to the axial conductor of a coaxial cable.

4. The RF coaxial connector of claim 3, wherein the contact is a male contact and the connector further comprises a collet fitted over the male contact for constraining a female contact of another connector, when connected to the male contact, from relaxing or splaying.

5. The RF coaxial connector of claim 1, wherein the first conductive mating portion is frusto-conical.

6. The RF coaxial connector of claim 1, wherein the waveway is formed in one piece.

7. The RF coaxial connector of claim 1, wherein the waveway incorporates at least one longitudinal split at least partially along one side of its length.

8. The RF coaxial connector of claim 1, wherein the waveway is formed of two separate element pieces provided in opposed configuration within the connector housing.

9. The RF coaxial connector of claim 1, wherein the internal axial passage of the connector housing is formed with an undulating internal profile along at least part of its length, and the waveway is provided by a separate conductive element having an outer profile that corresponds with said undulating internal profile of the connector housing.

10. The RF coaxial connector of claim 1, wherein the internal axial passage of the connector housing is formed with an undulating internal profile along at least part of its length, and the waveway is provided by a conductive coating on the internal axial passage of the connector housing to provide its undulating internal profile.

11. The RF coaxial connector of claim 1, wherein the undulating internal profile of the waveway is provided by a spiral shape around its interior.

12. The RF coaxial connector of claim 1, wherein the connector housing comprises an external helical thread at the first end of the connector housing for receiving a cable locking nut.

13. The RF coaxial connector of claim 1, wherein the connector housing comprises an external helical thread at the second end of the connector housing for receiving a connector locking nut for connecting two connectors together at their respective second ends in use.

14. The RF coaxial connector of claim 1, further comprising a cable and/or connector locking nut formed of non-conductive material.

15. The RF coaxial connector of claim 1, wherein the connector housing is formed of one or more of ABS, vulcanized rubber, polymer, ceramic, glass or composites thereof.

16. The RF coaxial connector of claim 1, wherein the connector housing incorporates hydrophobic material or a hydrophobic coating.

17. The RF coaxial connector of claim 1, being compatible with metal connectors.

18. A RF coaxial connector for terminating a coaxial cable, the connector comprising:

a tubular connector housing formed of non-conductive material, the connector housing having an internal axial passage extending between first and second ends, and a tubular conductive screening element provided within, and closely conforming with the internal shape of said axial passage of the connector housing, the screening element being formed of in one piece and having an internal axial passage extending between first and second ends of the screening element, wherein the axial passage of the screening element comprises electrically conductive material and has an undulating internal profile along a first part of a cross-sectional length of the screening element in order to cooperatively connect around an exterior surface of an outer screen conductor of a coaxial cable, and a, first conductive mating portion adjacent the first part, being one of a male/female gender, wherein the first conductive mating portion comprises a frusto-conical wall having a surface shaped so as to cooperatively conjoin in use with a frusto-conical wall of a second conductive mating portion of another connector screening element of the opposite male/female gender, the frusto-conical wall extending adjacent the first part having the undulating profile to the second end.

19. An RF coaxial connector system, comprising first and second connectors, each of the first and second connectors comprising:

a connector housing formed of non-conductive material, the connector housing having an internal axial passage extending between first and second ends; and a waveway, defined as being an electromagnetic screening and return path element within said axial passage of the connector housing, the waveway being formed of a single element and having an internal axial passage extending between first and second ends of the screening element, the axial passage of the waveway comprising electrically conductive material and having an undulating internal profile along at least part of a cross-sectional length of the waveway in order to cooperatively connect around part an exterior surface of an outer screen conductor of a coaxial cable passing through the first ends in use, the waveway being electrically isolated from the connector housing and providing a constrained return signal path for signals from the outer screen conductor of a connected coaxial conductor, the waveway further comprises a first conductive mating portion, being one of a male/female gender, wherein the first conductive mating portion comprises a frusto-conical wall having a surface shaped so as to cooperatively conjoin with a frusto-conical wall of a second conductive mating portion of another connector waveway of the opposite male/female gender, the frusto-conical wall extending adjacent the part having the undulating profile to the second end, and a dielectric component positioned within the first conductive mating portion and supporting a male/female contact for connection to the axial conductor of a coaxial cable, wherein the contact of the first connector is a male contact and the contact of the second connector is a female contact and wherein, in use, the first and second connectors are connected by connecting the first and second conductive mating portions together, one inside the other, whereby the male contact locates within the female contact.

20. The RF coaxial connector system according to claim 19, further comprising a connector locking nut which connects the second ends of the first and second connectors together in a water-tight manner.

* * * * *